United States Patent [19]

Irwin

[11] Patent Number: 4,716,613

[45] Date of Patent: Jan. 5, 1988

[54] PIPE CLEANING MACHINE

[76] Inventor: Lawrence F. Irwin, 12860 San Fernando Rd., Sylmar, Calif. 91342

[21] Appl. No.: 843,654

[22] Filed: Mar. 25, 1986

[51] Int. Cl.[4] ..... B08B 9/02

[52] U.S. Cl. ..... 15/104.33

[58] Field of Search ..... 15/104.3 SN, 104.3 R; 254/134.3 FT; 242/54

[56] References Cited

U.S. PATENT DOCUMENTS

| | | | |
|---|---|---|---|
| 3,703,015 | 11/1972 | Naeve | 15/104.3 SN |
| 3,958,293 | 5/1976 | Irwin | 15/104.3 SN |
| 4,290,162 | 9/1981 | Agostino | 15/104.3 SN |

*Primary Examiner*—Edward L. Roberts

*Attorney, Agent, or Firm*—James E. Brunton

[57] ABSTRACT

An improved pipe cleaning machine of the type which uses an elongated flexible coil spring or plumber's snake formed of helically wound spring wire which is housed within a rotatable spring storage reel, or drum, and is withdrawn therefrom for insertion into the pipe to be cleaned. The machine of the present invention embodies a novel dual drive arrangement which enables the drum to be rotated and the spring wire, or snake, fed into the pipe either by means of a small electric hand drill, which can be affixed to one shaft of the dual drive arrangement, or by a hand crank which can be detachably interconnected with a second shaft of the dual drive arrangement.

6 Claims, 9 Drawing Figures

FIG. 6
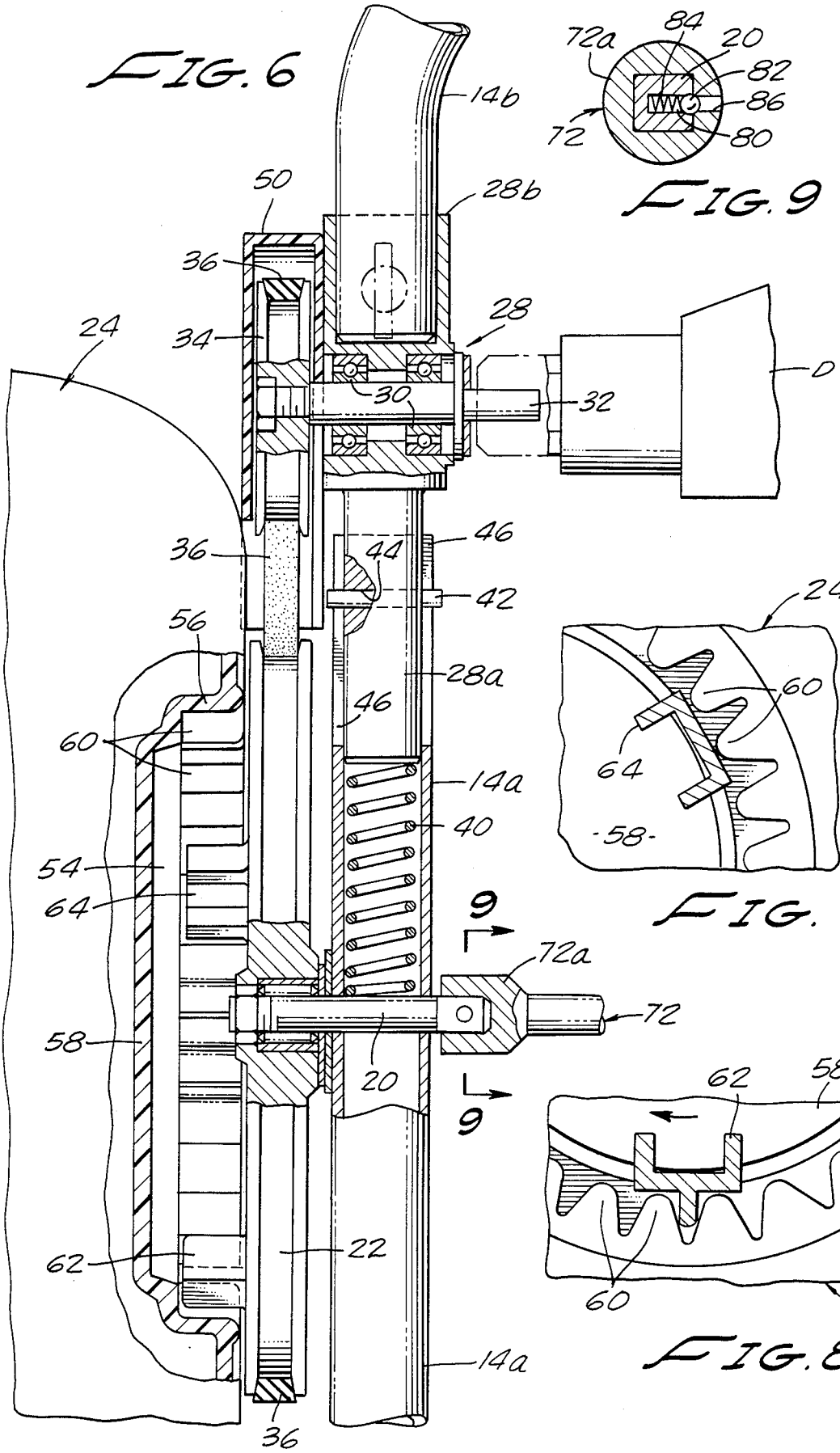
FIG. 9
FIG. 7
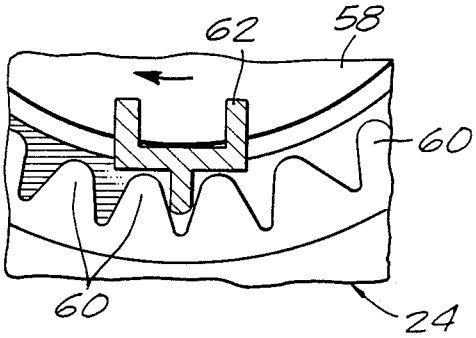
FIG. 8

PIPE CLEANING MACHINE

BACKGROUND OF THE INVENTION

1. Field of the Invention

This invention relates generally to pipe cleaning machines, and more particularly to a machine for storing and rotatably feeding and retracting, either by hand or by electric motor, a flexible plumbers' snake formed of helically wound spring wire.

2. Description of the Prior Art

Several types of hand and power driven pipe clean out machines have been developed in the past. Most of the machines, which have enjoyed commercial success, are either very small hand operated machines or comparatively large motor operated machines. The small hand operated machines are frequently unsuitable for cleaning out severe blockages or blockages which occur in longer lengths of sewer drain lines at a remote location from the clean-out plug. Conversely, the prior art power operated clean out tools are generally quite large and frequently are too cumbersome and too difficult to operate to be practical for use by the untrained operator or home owner.

One of the most successful of the larger power operated pipe cleaning machines is described in U.S. Pat. No. 3,095,592, issued to Robert G. Hunt. Another hightly successful type cleaning machine is disclosed in U.S. Pat. No. 3,958,295, issued to the present inventor. This machine, like the Hunt machine, however, is fairly large and, like the Hunt machine, embodies a fixedly mounted electric motor. Accordingly, neither of the aforementioned machines can be conveniently hand operated.

As will become apparent from the discussion which follows, in the machine of the present invention the drum which houses the snake can be rotated either by a separately provided standard type electric hand drill or by a hand crank arrangement. The electric drill can be quickly and easily connected to a first drive shaft using the drill chuck provided on the electric drill. Alternatively, the hand crank can readily be detachably interconnected with a second drive shaft for small clean out jobs that do not require any type of power drive.

An additional advantage of the construction of the machine of the present invention is that the machine is very small, compact, and lightweight. Accordingly, it can be easily operated by the untrained home owner using a small hand drill of the character typically found in the home work shop. Alternatively, for small jobs such as cleaning a clogged trap or the like, the machine can be conveniently operated by hand.

SUMMARY OF THE INVENTION it is an object of the invention to provide a new and significantly improved, small pipe cleaning machine of the type which comprises an elongated, flexible coil spring or plumbers' snake formed of helically wound spring wire which can be controllably withdrawn from a spring housing, or drum, for insertion into the pipe to be cleaned.

Another object of the present invention is to provide a machine of the aforementioned character which embodies two separate drive mechanisms. A small electric hand drill can be connected to one of the drives using the chuck provided on the hand drill which normally holds the drill bit. A hand crank can be conveniently connected to the second drive for hand operation of the machine.

It is another object of the invention to provide a machine of the type described in the proceeding paragraph in which the storage reel or drum is so constructed and arranged as to permit the expeditious removal of the storage reel thereby enabling quick change to another storage reel, for example. containing a coiled spring of a different size.

Still another object of the invention is to provide a machine which is compact, lightweight, and portable and one which is easy and inexpensive to manufacture and yet is extremely durable and reliable.

These and other objects of the invention are realized by a pipe cleaning of the type characterized by having an elongated, flexible plumbers' snake formed of helically wound spring wire which is stored within the machine in a coiled configuration and can be withdrawn forwardly of the machine upon rotation of the snake for insertion thereof into the pipe to be cleaned. The machine of the invention can be powered by a small, standard type electric hand drill having a drill bit holding chuck, or alternatively, can be hand operated. The machine comprises a frame, a one piece spring housing rotatably mounted on the frame including a generally annular shaped rear portion adapted to contain the spring in a coiled configuration and a generally frustoconically shaped forward guide portion in communication wit the rear portion and adpated to accommodate passage of the spring therethrough; a pair of spaced apart drive mechanisms for rotating the spring housing, the first drive mechanism comprising a first drive shaft receivable within the drill bit holding chuck of the drill for rotation of the first drive shaft and a second drive mechanism comprising a second drive shaft which can be detachable interconnected with a hand crank assembly. Feed means are mounted forwardly of the spring housing for releasably gripping the rotating spring to urge controlled axial movement thereof upon rotation of the spring housing or drum.

BRIEF DESCRIPTION OF THE DRAWINGS

FIG. 6 is a greatly enlarged, fragmentary side elevation cross sectional view illustrating the construction of the drive mechanisms of the apparatus of the invention.

FIG. 7 is a greatly enlarged, fragmentary view illustrating the construction of the drum locating members of the drive wheel of the invention.

FIG. 8 is a greatly enlarged, fragmentary view similar to FIG. 7, further illustrating the construction of the drum drive member carried by the drive wheel of the invention.

FIG. 9 is a fragmentary cross sectional view taken along lines 9—9 of FIG. 6, showing the construction of a locking detent adapted for use in the interconnection of the hand crank drive mechanism with one of the drive shafts.

DESCRIPTION OF ONE FORM OF THE INVENTION

Figure 1:
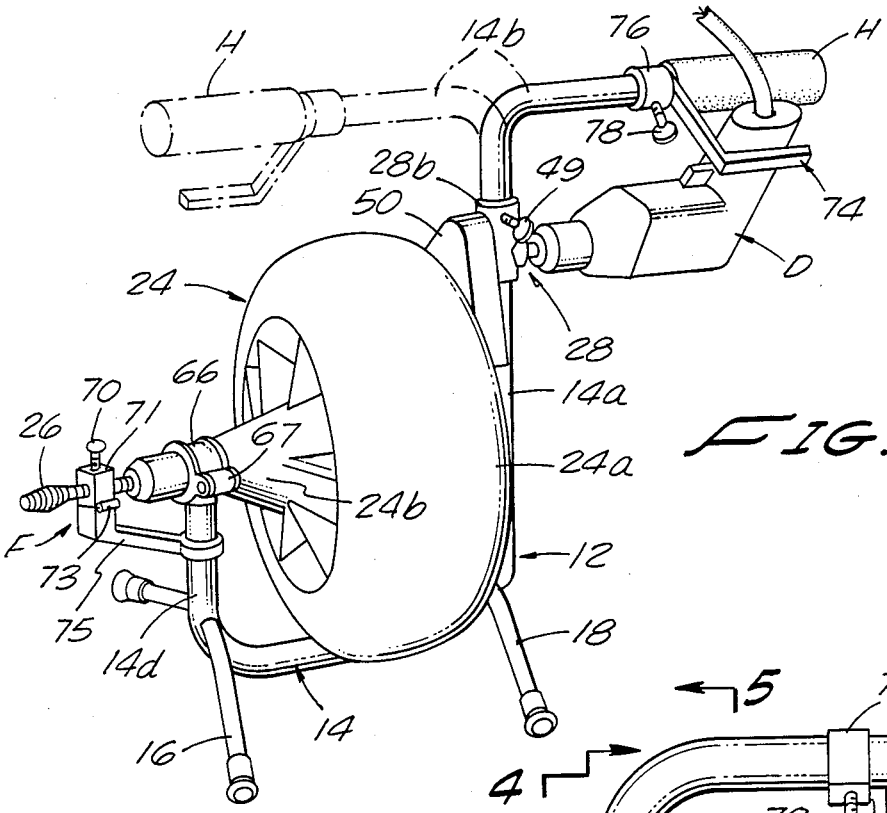
FIG. 1 is a generally prospective view of the sewer clean out tool of the invention.
Figure 2:
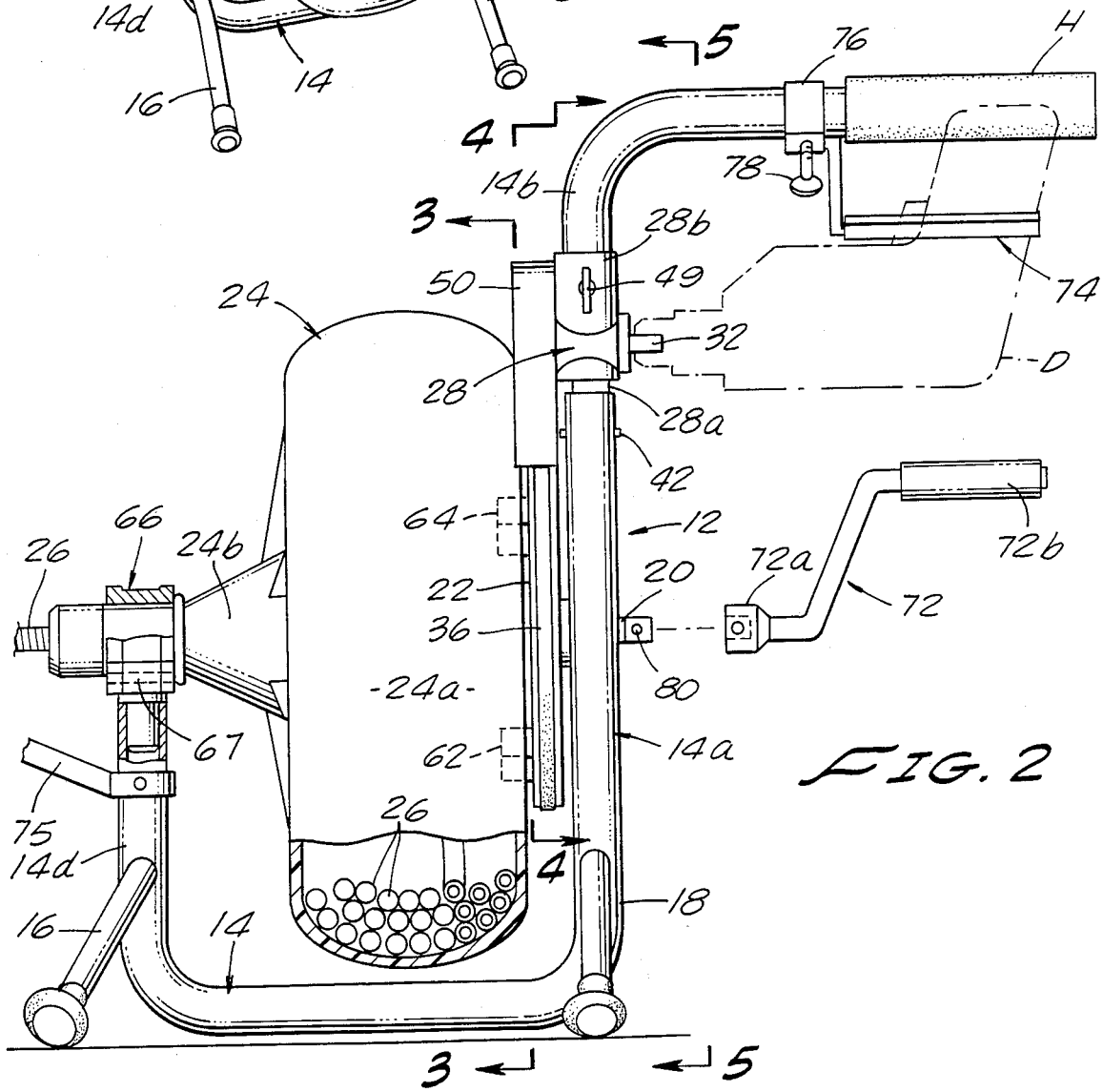
FIG. 2 is an enlarged, side elevational view of the sewer clean out tool partly broken away to show internal construction.

Referring to the drawings, and particularly to FIGS. 1 ande 2, the machine includes a frame generally designated by the numeral 12. As best seen in FIG. 2, frame 12 comprises a generally u-shaped, tubular member 14 to which is affixed forward supporting legs 16, and rearward supporting legs 18.

Referring also to FIG. 6 of the drawings, a first shaft 20 is rotatably carried by the vertically upstanding leg portion 14*a* of frame 14. The forward end of shaft 20 is threaded and the rearward end thereof is provided with a detent mechanism, the purpose of which will presently be described. Threadably interconnected to the forward end of shaft 20 is a driven member or sheave 22. Detachably connected to the forward face of sheave 22, which forms the drive wheel of the invention, is a spring housing, or drum 24.

As best seen in FIG. 2, drum 24 is of a one-piece molded construction and includes a generlaly annular shaped rear portion 24*a* adapted to contain the coiled spring or plumbers' snake 26 and a generally frustoconically shaped forward guide portion 24*b* in communication with rear portion 24*a* and adapted to accommodate passage of the spring therethrough in the manner shown in FIG. 2.

Referring again to FIG. 1, 5 and 6, a downwardly depending leg of a generally "L" shaped upper portion 14*b* of frame 14 is telescopically received within a bearing assembly 28. The free end portion of this "L" shaped leg defines a handle "H". Bearing assembly 28, which comprising spaced apart roller bearings 30, is disposed intermediate portions 14*a* and 14*b* at a spaced apart location from shaft 20 (FIG. 6). Bearing assembly 28 is adapted to rotatably carry a second shaft 32, the rearward extremity of which is receivable within the drill bit holding chuck of a standard, electrically operated hand drill (generally designated in the drawings by the letter D). The forward end of shaft 32 is threaded to threadably receive a driving member or second sheave 34. Sheave 34 is approximately one third the diameter of sheave 22 so that the speed of rotation of the drum 24, which is removably connected to sheave 22, will be reduced considerably from the speed of rotation of sheave 34 as it is rotatably driven by the electric drill D. It is to be understood that by varying the diameter of sheave 34, various speeds of rotation of sheave 22 and drum 24 which is connected thereto can be achieved. Interconnectionmeans are provided for interconnecting driving member or sheave 34 and driven member or sheave 22, whereby rotational movement of the driving member will impart rotational movement to the driven member. In the present form of the invention, this interconnection means is provided in the form of an endless drive belt 36, which is receivable over and about sheaves 22 and 34.

Disposed within hollow tube portion 14*a* of the frame intermediate shaft 20 and bearing assembly 28 is a biasing means for urging separation of frame portion 14*a* and bearing assembly 28 thereby urging separtion between sheaves 22 and 34 for maintaining tension on druve belt 36. In the present form of the invention, this biasing means comprises a coiled spring 40, the lower end of which rests against shaft 20 and the upper end of which engages the lower tubular portion 28*a* of frame assembly 28. Bearing assembly 28 and frame portion 14*a* are held in axial alignment by means of a locking pin 42 which passes through apertures 44 formed in tubular portion 28*a* of the bearing assembly. As can be seen by also referring to FIG. 5, pin 42 is also receivable within diametrically opposed elongated slots 46 formed in portion 14*a* of the frame. When pin 42 is in the position illustrated in FIG. 6, belt 36 is maintained in optimum driving tension. When it is desired to remove and replace belt 36, frame portion 14*b* is pushed downwardly against the urging of spring 40 so as to being sheaves 34 and 22 closer together to permit the removal of belt 36.

Figure 5:
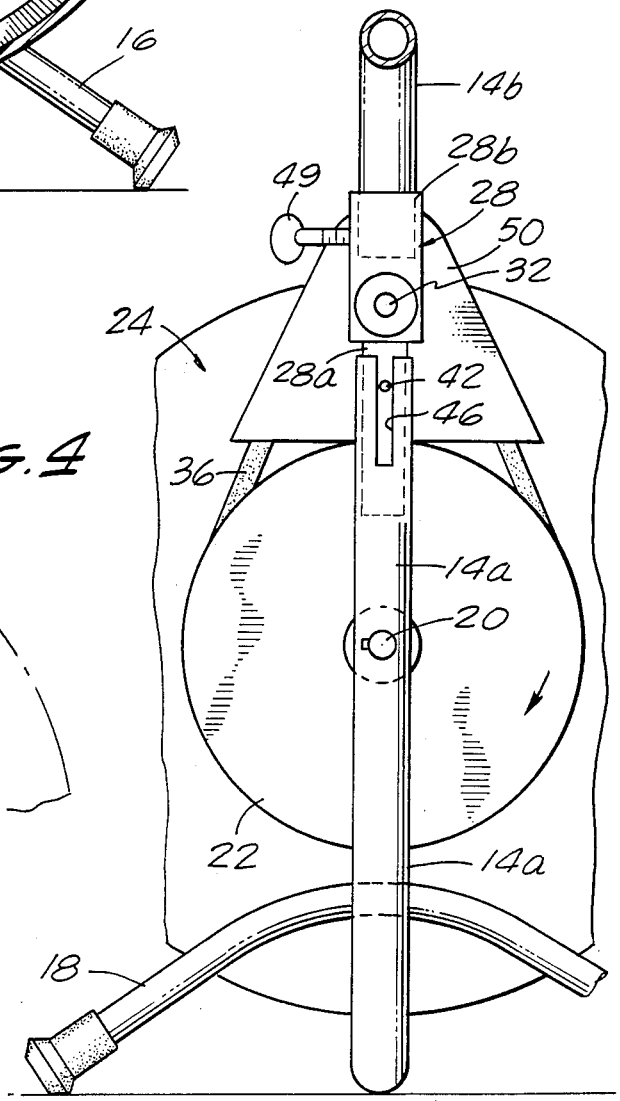
FIG. 5 is a fragmentary view, partly in cross section, taken along lines 5—5 of FIG. 2.

Referring to FIG. 1, it can be seen that "L" shaped portion 14*b* of the frame is rotatable through an angle of 180° from the position shown in the solid lines in FIG. 1 into the storage or transport position shown by the phantom lines in FIG. 1. A threaded thumb screw 49 is threadably carried by an upper tubular shaped portion 28*b* of the bearing assembly and, as shown in FIG. 5, can be tightened against frame portion 14*b* to prevent accidental rotation thereof into the storage position.

Also adjustably carried by bearing assembly 28 is a belt guard 50 which encloses sheave 34 and belt 36 when the apparatus is in the operating position shown in FIG. 6.

Figure 3:
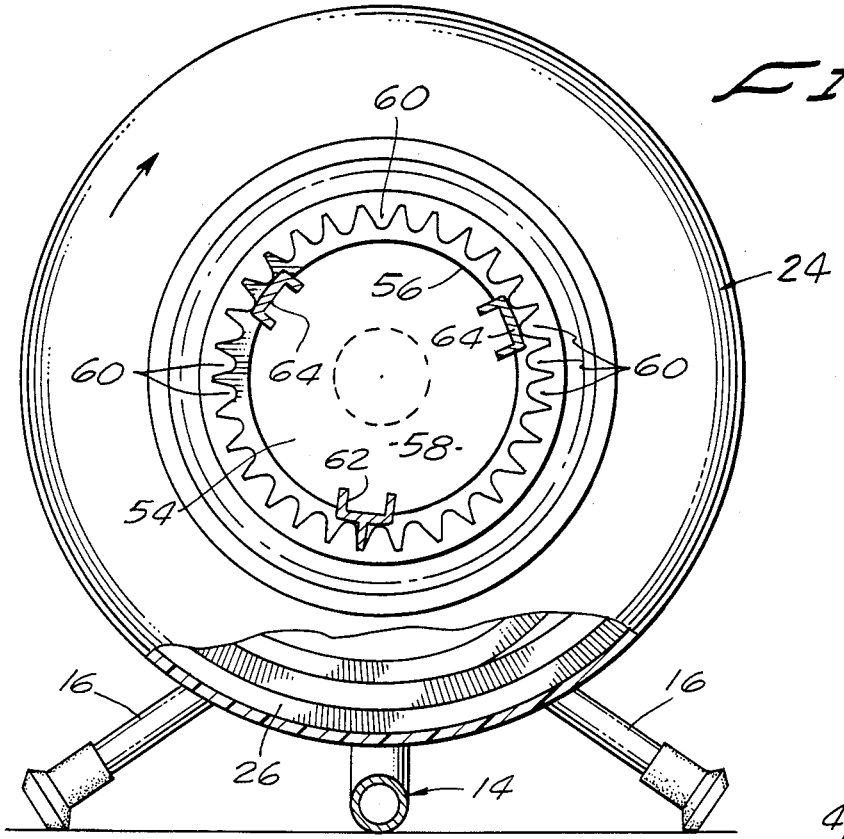
FIG. 3 is a view taken along lines 3—3 of FIG. 2, partly broken away to shown internal construction.
Figure 4:
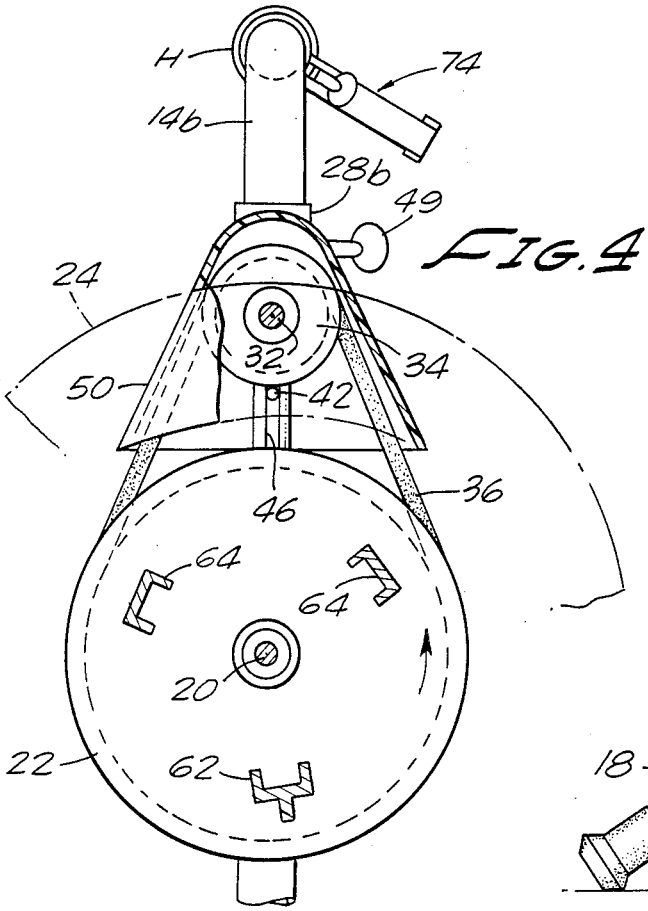
FIG. 4 is a view taken along lines 4—4 of FIG. 2, showing the drum drive arrangement for this embodiment of the invention.

Turning to FIGS. 3 and 6, spring storage container, or drum 24, is provided with an annular shaped rearwardly extending cavity 54. Cavity 54 is defined by an inturned annular shaped wall 56 which is integrally formed with a front closure wall 58 (FIG. 6). Formed on annular wall 56 is a multiplicity of circumferentially spaced apart radially inwardly extending tooth-like protrusions 60 (FIG. 3). Protrusions, or teeth, 60 are so constructed and arranged as to mate with a forwardly extending driving spur, or tooth, 62 provided on the forward face of sheave 22. With this construction, rotation of sheave 22 either by belt 36 or by shaft 20 will cause concimitant rotation of spring housing, or drum , 24 about the axis of shaft 20. To maintain drum 24 in coaxial alignment with the axis of shaft 20, a pair of spaced apart generally U-shaped locating members 64 are also carried by, and protrude forwardly from, sheave 22. As indicated in FIG. 3, these locating members 64 are closely receivable within the annular space defined by the extremities of teeth 60.

Referring particularly to FIG. 2, affixed proximate the upper extremity of forward leg portion 14*d* of frame 14 is a hinged bearing 66 which, when in its closed position as shown in FIG. 2, rotatably supports the forward neck portion of drum 24 and holds the drum in coaxial alignment with the axis of rotation of shaft 20. As indicated in FIG. 1, hinged bearing 66 is adapted to pivot into an open position about hinge pin 67 which interconnects the upper and lower halves of bearing 66.

When it is desired to remove and replace drum 24, the hinged feed means presently to be described and the hinged bearing 66 can be moved into their open position and drum 24 slid forwardly and upwardly to move the drive spur 62 and the guide elements 64 out of engagement with teeth 60. A replacement drum carrying another size snake can then be positioned in the device and the hinged bearing returned to its closed position shown in FIG. 1.

Carried by the forward leg 14*d* of the frame 14 is a feeding means "F" for pressurally engaging the snake 26 to cause axial movement thereof upon rotation of drum 24. In the embodiment of the invention shown in the drawings, this feed means is provided in the form of a threaded thumb screw 70 carried within a radially extending threaded bore formed in the top plate 71 of an assembly which is hingably connected by hinge pin 73 to a forwardly extending bracket 75 carried leg 14*d*. Thumb screw 70 can be tightened to bring the inner extremity thereof into contact with the coiled spring, or rotating snake, 26 to urge axial movement thereof as the drum 24 is rotated. It is to be understood that the feed means of the invention is not limited to the simple thumb screw arrangement shown in the drawings, but may be provided in the form of feed means of various designs. For example, the feed means shown and described in U.S. Patent to Hunt U.S. Pat. No. 3,095,592 can be suitably mounted to the frame of the device of the present invention and function to impart controlled axial movement of the snake upon rotation movement of drum 24. Similarly, various other types of feed means can be used to engage the rotating spring so as to cause it to be advanced of the apparatus and it is not intended that the scope of the present invention be limited to the form of the feed means shown in the drawings.

OPERATION

With the drum 24 housing the snake 26 in position on the apparatus in the manner illustrated in FIGS. 1 and 2, the device can be operated either by hand using a hand crank 72 (FIG. 2) or can be power operated using a hand drill "D". The hand drill may be of a standard commercially available ¼" or ⅜" type having a standard three or four jaw drill bit engaging chuck thereon. When the hand drill is used, shaft 32 is inserted into the chuck of the drill and the chuck securely tightened against shaft 32. Energization of the drill by activating the trigger type start switch will impart rotation to shaft 32 and also to sheave 34. Of course, stop or counter rotation means must be provided to hold the hand drill stationary relative to the handle H. In the form of the invention shown in the drawings, this stop means comprises a generally "Z" shaped bracket 74 attached to the handle portion by a connector bracket 76. Connector bracket 76 is provided in the form of a sleeve receivable over frame portion 14*b* and one leg of "Z" bracket 74 and includes a threaded thumb screw 78 adapted to securely clamp the "Z" bar in position against frame portion 14*b*. With the "Z" bar 74 locked in the position shown in FIG. 1, the outer leg of the "Z" bar is spaced apart from the handle a sufficient distance to readily accept the handle grip portion of the electric drill "D" in the manner illustrated in FIG. 1.

For small cleanout jobs where power drive is not necessary, the hand crank 72 can be conveniently used to rotate drum 24 through rotation of shaft 20. Turning particularly to FIG. 9, it is to be observed that shaft 20 is generally rectangular in cross-section, at its rearward extremity, and includes a radially extending bore 80. Receivable within bore 80 is a spherical member 82 which is urged radially outwardly by a small coil spring 84 disposed within bore 80. Bore 80 is peened over, or otherwise set, to restrict the extent of radically outward travel of spherical ball 82 within th bore. As indicated in FIG. 2 and 9, crank 72 has an enlarged diameter connector head portion 72*a* which is provided with a radial bore 86 of a diameter to closely accept a portion of spherical ball 82. With this type of detent arrangement, when the connector head portion 782*a* of crank 72 is placed over the rear extremity of shaft 20, spherical member 82 will be urged outwardly by spring 84 into bore 86 of the crank head so as to removably interlock the crank 72 with the rear extremity of shaft 20. By gripping the handle portion 72*b* of crank 72, and imparting a rotational force thereto, shaft 20 will, of course, be rotated, which in turn will impart rotation to sheave 22 and also to drum 24 via drive spur 62.

During the hand operation of the device, drive belt 36 moved free of sheave 34 in a manner previously described. This will then permit free rotation of sheave 32. However, in normal opeation, once the hand drill "D" has been disconnected from shaft 32, the normal drag imparted by sheave 34 and belt 66 to rotation of shaft 20 is minimal and will not adversely affect the hand rotation of the drum using crank 72.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. A pipe cleaning machine which can be powdered either by hand or by a standard type of electric hand drill having a drill bit holding chuck, the machine being of the type characterized by having an elongated flexible plumbers' snake or spring formed by helically wound spring wire which is stored within the machine in a coiled configuration and can be withdrawn forwardly of the machine for inserting into the pipe to be cleaned, comprising:

(a) a frame;

(b) a first shaft rotatably carried by said frame;

(c) a driven member carried by said first shaft for rotation therewith;

(d) a spring housing for housing the snake, said spring housing having an opening formed therein for receiving at least a portion of said driven member to impart rotation to said spring housing upon rotation of said first shaft;

(e) a hand crank detachably interconnected with said first shaft for imparting rotation thereto;

(f) a second shaft rotatably carried by said frame at a spaced apart location from said first shaft, said second shaft being receivable within the drill bit holding chuck for rotation by the hand drill;

(g) a driving member carried by said second shaft for rotation therewith;

(h) interconneciton means for interconnecting said driving member and said driven member, whereby rotational movement of said driving member will impart rotational movement to said driven member; and (i) feed means mounted on said frame forwardly of said spring housing for releasably gripping said spring to urge axial movement thereof upon rotation of said spring housing.

2. A pipe cleaning machine as defined in claim 1 including stop means carried by said frame for limiting counter rotation of the hand drill.

3. A pipe cleaning machine as defined in claim 2 in which said stop means comprises a generally "Z" shaped bracket carried by said frame.

4. A pipe cleaning machine as defined in claim 3 in which said opening in said spring housing is provided with a plurality of circumferentially spaced tooth-like elements extending radially inwardly from said annular shaped cavity and in which said driven member comprises a drive spur receivable intermediate said tooth-like elements to drivably engage one of said tooth-like elements, whereby rotation of said first sheave will impart rotation to said spring housing.

5. A pipe cleaning machine as defined in claim 4 in whcih said driven member further includes a pair of circumferentially spaced generally U-shaped locating members for maintaining said spring housing in substantial coaxial alignment with the axis of said first shaft.

6. A pipe cleaning machine which can be powered either by hand or by a standard type of electric hand drill having a drill bit holding chuck, the machine being of the type characterized by having an elongated flexible plumbers' snake or spring formed by helically wound spring wire which is stored within the machine in a coiled configuration and can be withdrawn forwardly of the machine for inserting into the pipe to be cleaned, comprising:

(a) a frame;

(b) a first shaft roataably carried by said frame;

(c) a driven member carried by said first shaft for rotation therewith, said driven member comprising a first sheave having an outwardly extending drive spur;

(d) a spring housing for housing the snake, said spring housing being carried by said driven member for rotation therewith, said spring housing being provided with an annular shaped cavity having a plurality of circumferentially spaced tooth-like elements extending radially inwardly from said annular shaped cavity, said first sheave being receivable within said annular shaped cavity with said drive spur extending intermediate two of said plurality of circumferentially spaced tooth-like elements, whereby rotation of said first sheave will impart rotation of said spring housing;

(e) a hand crank detachably interconnected with said first shaft for imparting rotation thereto;

(f) a second shaft rotatably carried by said frame at a spaced apart location from said first shaft, said second shaft being receivable within the drill bit holding chuck for rotation by the hand drill;

(g) a driving member carried by said second shaft for rotation therewith, said driving member comprising a second sheave;

(h) interconnection means for interconnecting said driving member and said driven member, whereby rotatinal movement of said driving member will impart rotational movement to said driven member, said interconnection means comprising an endless belt drivably interconnecting said first and second sheaves; and (i) feed means mounted on said frame forwardly of said spring housing for releasably gripping said spring to urge axial movement thereof upon rotation of said spring housing.

* * * * *